United States Patent [19]

Studer

[11] 4,165,709

[45] Aug. 28, 1979

[54] TABLET DISPENSER

[75] Inventor: John E. Studer, Flemington, N.J.

[73] Assignee: Ortho Pharmaceutical Corporation, Raritan, N.J.

[21] Appl. No.: 871,869

[22] Filed: Jan. 24, 1978

[51] Int. Cl.[2] ..... B65D 83/04; B65D 85/56; G09F 9/00

[52] U.S. Cl. ..... 116/308; 206/531; 206/534; 206/539; 221/5; 221/86

[58] Field of Search ..... 206/531, 539, 532, 534, 206/538, 539; 221/86, 5; 116/121

[56] References Cited

U.S. PATENT DOCUMENTS

| | | | |
|---|---|---|---|
| 3,199,489 | 8/1965 | Ruoss et al. | 116/121 |
| 3,276,573 | 10/1966 | Kaufman et al. | 206/531 |
| 3,303,927 | 2/1967 | Ballard | 206/539 |
| 3,651,927 | 3/1972 | Richardson et al. | 116/121 |
| 3,743,085 | 7/1973 | Richert | 116/121 |
| 3,800,940 | 4/1974 | Thomas | 206/539 |
| 3,904,075 | 9/1975 | Richardson et al. | 221/5 |
| 4,015,717 | 4/1977 | Richardson et al. | 221/5 |

*Primary Examiner*—William T. Dixson, Jr.
*Attorney, Agent, or Firm*—Richard J. Rodrick

[57] ABSTRACT

A tablet dispensing device comprises a substantially flat support having a single tablet dispensing aperture therein. A tray is adapted to rotate on one surface of the support and has a plurality of openings therein disposed in a circular orientation. The openings are arranged to individually align in registration with the aperture upon rotation of the tray. The tray is adapted to receive a tablet dispensing package containing a plurality of tablets. A tablet is dispensed by pressing it from the package through its corresponding opening in the tray and then through the aperture in the support for collection by the operator thereof. Rotation of the tray sequentially places each opening over the aperture in alignment therewith so that the remaining tablets can be individually dispensed.

24 Claims, 9 Drawing Figures

Fig. 1.
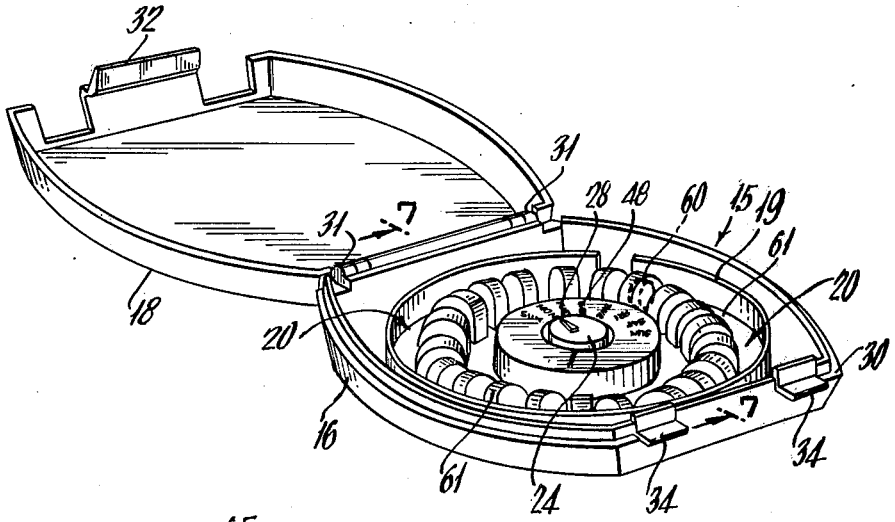
Fig. 2.
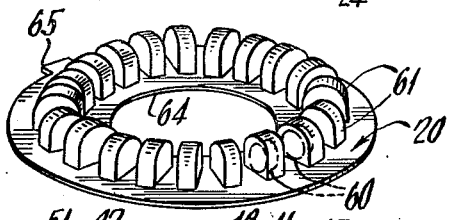
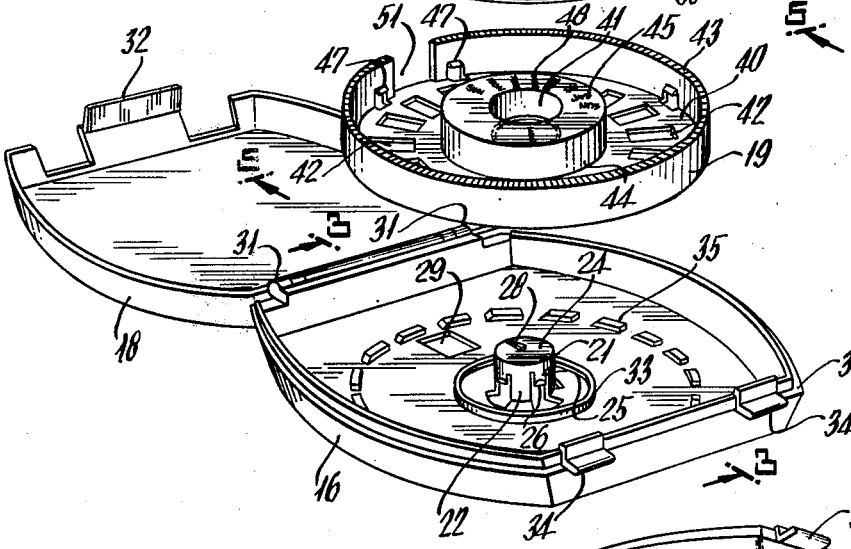
Fig. 9.
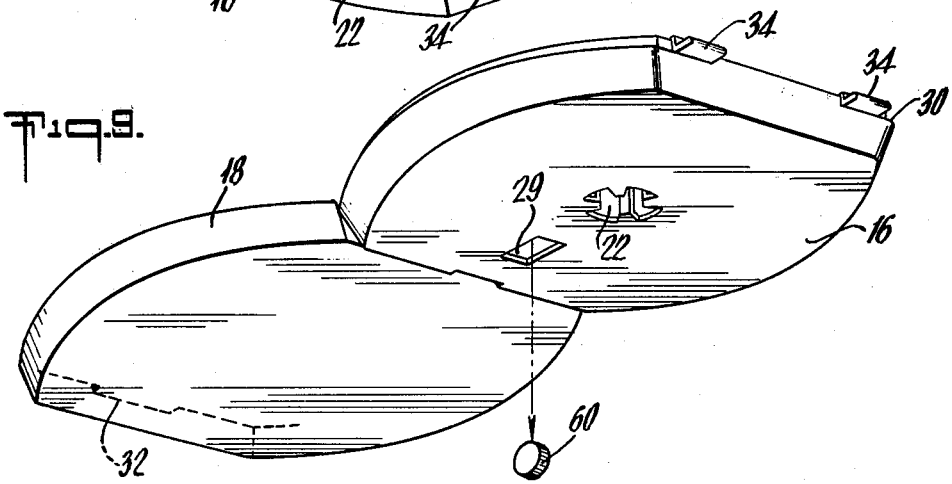

TABLET DISPENSER

BACKGROUND OF THE INVENTION

The present invention relates to a device for dispensing tablets, and more particularly concerns a tablet dispenser for dispensing a solid-form pharmaceutical preparation on a periodic regimen.

Medicaments and other pharmaceutical preparations are often prescribed for the patient on a time related basis. Whether the time schedule be daily, multiple doses per day or less frequent doses, it is important that the prescribed amount and regimen be adhered to by the patient. In taking solid-form pharmaceutical preparations, the amount of dosage is inherently controlled. Thus, each tablet is prepared to contain a fixed amount of dosage, so that there is little or no confusion in the amount which should be taken. As used herein, tablet means any solid-form pharmaceutical preparation including a pill, capsule and the like wherein the dosage of each unit is fixed by the size, weight and other characteristics of the solid form. On the other hand, some uncertainty, forgetfulness and confusion as to whether or not the tablet has been taken at the prescribed rate and time may easily be engendered, especially when the dosage is to be repeated a number of times daily or when multiple medicaments are prescribed to be taken at various times. As a result of this confusion and uncertainty, the patient may, in reality, take more or less than the prescribed rate of dosage, thereby altering the intake which he should be receiving.

Tablet dispensers and devices for dispensing solid-form pharmaceutical preparations especially in a time related sequence have become well known. For instance, the tablet dispenser will include a plurality of tablets and time related indicia referenced to the tablets. Thus, the user of the dispenser is readily informed as to the time period when the tablet should be taken; also, when the tablet containing portion of the dispenser is empty, it readily informs the user that the tablet for that time period has been taken, thereby eliminating any uncertainty in that regard. Representative examples of tablet dispensers are disclosed in U.S. Pat. Nos. 3,904,075; 3,800,940; 3,743,085; 3,651,927 and 3,276,573. These patents describe some of the various ways to dispense tablets individually in a time related fashion; however, in the search for a more reliable means of dispensing tablets on a time related basis, in conjunction with simplicity of operation, improved functionability and economies of operation along with inexpensive cost of manufacture and convenience to the user, there is still room for further improvements in this field of tablet dispensers.

SUMMARY OF THE INVENTION

A tablet dispensing device comprises a substantially flat support having a single tablet dispensing aperture therein. A tray is adapted to rotate on one surface of the support and has a plurality of openings therein disposed in a circular orientation. The openings are arranged to individually align in registration with the aperture in the support upon rotation of the tray. The tray is adapted to receive a tablet dispensing package containing a plurality of tablets which are individually dispensable through the specific opening in the tray which is aligned with the aperture. Subsequent tablets are individually dispensed by rotating the tray so that the next opening, in sequence, aligns with the aperture. Tablets are dispensed merely by pressing them from the package through the corresponding openings, and then through the aperture for collection by the operator thereof.

In the preferred embodiment of the present invention, the tray has an upraised annular portion surrounding a central hole, the annular portion lying between the hole and the plurality of openings. On a flat upper face of the annular portion, there are indicators of periodicity, an indicator referenced to each opening in the tray and sequentially arranged around the upper face of the annular portion. Thus, each opening and corresponding tablet are marked in a time related order so that the user of the dispenser is made aware of the time frame in which the tablet should be taken. Additionally, this embodiment includes mating sets of ratchet teeth on the support and the tray, adapted for intermittent engagement with each other to allow incremental rotation of the tray on the support in one rotative direction, but not the other. The tablets are preferably incorporated in a removable tablet package disposed on the tray. The package is comprised of a plurality of collapsible pockets which contain the tablets. The pockets are disposed in a circular orientation to correspond with the orientation of the openings in the tray so that a tablet is disposed in alignment with each of the openings. A frangible membrane covers the pockets and is interposed between the pockets and the openings. Thus, when a tablet is ready to be dispensed, the pocket which is in registry with the aperture and the support is collapsed, for example, by finger pressure, thereby urging the tablet to fracture the frangible membrane and pass through the opening and then the aperture. When the supply of tablets in the package has been exhausted, the package is removable and replaceable with another tablet package so that the dispenser itself need not be discarded. A cover for this embodiment is hingedly attached to the support and is adapted to protectively cover the tablet package until the operator desires to dispense a tablet whereupon the cover swings open to provide access to the package within. Other covers may also be used, including those which are entirely removable.

From the structural standpoint, the tablet dispenser of the present invention is notably different from prior tablet dispensers in a number of respects. The combination of stationary support with a single tablet dispensing aperture, the rotatable tray with a plurality of openings therein for individual alignment with the aperture, and the collapsible pockets each containing a tablet corresponding in orientation with the openings of the tray, the tablets maintained in position by a frangible membrane covering the openings, has provided a most functional but yet simple and convenient tablet dispenser for the purpose of dispensing tablets in a time related regimen.

In accordance with the principles of this invention, the tablet dispenser hereof advantageously provides means to conveniently dispense a tablet on a time related regimen while dispelling the uncertainty as to whether the tablet has or has not been taken. Furthermore, the preferred embodiment of this invention incorporates a replaceable tablet package so that the dispenser may be reused many times, the replaceability of the tablet package being accomplished by merely removing the exhausted tablet package itself and inserting a new, full tablet package. Moreover, the structure of the tablet dispenser is designed for convenience and easy handleability and its compact-like configuration allows it to be held in the palm of the hand and then readily slipped into a pocket or purse until its next use.

BRIEF DESCRIPTION OF THE DRAWINGS

FIG. 1 is a perspective view of the preferred tablet dispenser of the present invention;

FIG. 2 is an exploded perspective view illustrating the elements of the embodiment of FIG. 1;

FIG. 3 is a cross-sectional view taken along lines 3—3 of FIG. 2;

FIG. 9 is a bottom perspective view illustrating a tablet being dispensed through the aperture in the support of the tablet dispenser.

DETAILED DESCRIPTION

Figure 5:
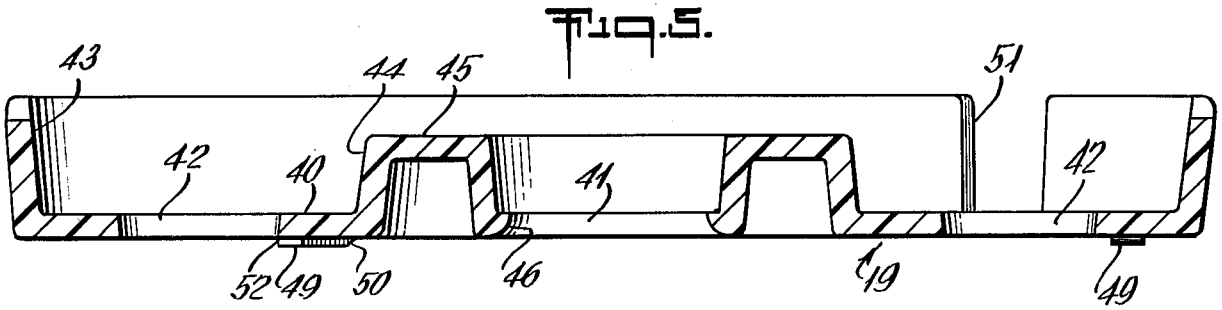
FIG. 5 is a cross-sectional view taken along lines 5—5 of FIG. 2.

While this invention is satisfied by embodiments in many different forms there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be pointed out in the appended claims.

Adverting to the drawings, particularly FIGS. 1 and 2, there is illustrated the preferred tablet dispenser 15 of the present invention. Tablet dispenser 15 is comprised of a support 16, a cover 18, a tray 19 and a tablet package 20.

Support 16 is a substantially flat member which serves to carry and support the tray and tablet package and is more clearly shown in FIGS. 2 and 3. Located substantially centrally on one surface of support 16 is a raised hub 21. Hub 21 has a generally cylindrical configuration and in this instance, has eight spoke-like elements forming a ring about its circumference. Four of these spokes are support spokes 22 which extend generally vertically from flat support 16 to the raised upper portion 24 of hub 21 so that the hub is essentially upstanding on four legs. Projecting generally downwardly from upper portion 24 and spaced alternately between support spokes 22 are four resilient, spring-like spokes 25 which do not extend completely down to the flat support. A small spherically shaped protuberance 26 is located at the lower end of resilient spokes 25 and cooperates with resilient spokes 25 to provide an attachment for tray 19 to support 16 as hereinafter discussed in greater detail. An optional pointer 28 is located on flat upper portion 24 of the hub, the pointer being molded integrally with the hub for economies of manufacture. In this instance, pointer 28 points along the longitudinal axis of base 16, but may be designed to point in other directions when desirable. Moreover, other means to designate to the user which tablet is to be taken may be employed.

Support 16 also includes an annular ridge 33 spaced a short distance from hub 21 and surrounding the same. Ridge 33 is basically a small protuberance or bump integrally formed in the flat portion of the support and serves to locate and position tray 19 when attached to support 16.

Spaced apart from hub 21 is a single tablet dispensing aperture 29. Aperture 29 is substantially rectangularly shaped and extends completely through flat support 16. In this embodiment, aperture 29 is also located on the longitudinal axis of support 16 so that pointer 28 points directly thereat. Support 16 also includes a ridge 30 around its periphery to provide a dish-like effect, ridge 30 serving to provide an effective closure when cover 18 is mated thereover. Thus, ridge 30 cooperates to make the tablet dispenser attractive while keeping its nature conveniently compact. Cover 18 is substantially similar in size and shape to support 16 and is hingedly attached to support 16 by two pairs of opposing ball and socket-type snap-in joints 31. Cover 18 thereby swings over support 16 with its components supported thereon, and serves as a protective member covering and overlying the same. A tab 32 on cover 18 interlocks with ridge 30 on support 16 and fits between a pair of finger grips 34 located on ridge 30. To open the closed dispenser, the user merely holds one or both of finger grips 34 while pushing upwardly on tab 32 of the cover thereby providing access to the interior portion of the dispenser.

A first set of ratchet teeth 35 upstands from the flat surface of support 16. The set is comprised of an array of teeth, there being the same number of teeth 35 to correspond with the number of tablets included in tablet package 20; thus, while the present embodiment illustrates twenty-one (21) ratchet teeth 35, the number may vary according to the design and purpose of the tablet dispenser. When the dispenser is to be primarily utilized to dispense birth control or oral contraceptive preparations which are to be taken on a daily regimen, it is most suitable to design the dispenser to accommodate twenty-one (21) or twenty-eight (28) tablets or other amounts, preferably in multiples of seven. For individual dispensing purposes, the number of ratchet teeth 35 will thus correspond with the number of tablets. Each tooth 35 is essentially an elongated, raised protuberance on the surface of the support, and includes an inclined edge which forms an angle with respect to the flat portion of the support. As illustrated especially in FIG. 2, teeth 35 are intermittently spaced in their circularly oriented array. The function of ratchet teeth will be discussed in greater detail hereinafter.

Figure 4:
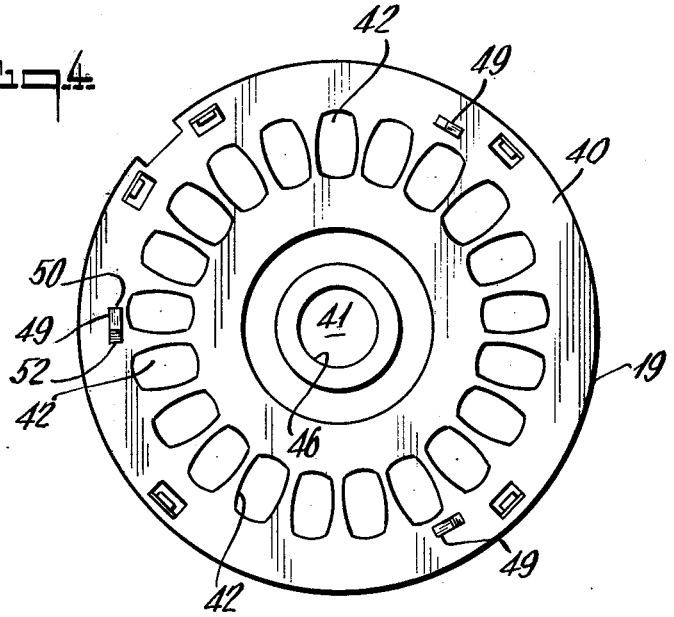
FIG. 4 is a bottom view of the tray.

Turning now to the description of tray 19, and referring particularly to FIGS. 2, 4 and 5, it can be seen that tray 19 is circularly shaped and its predominant portion is substantially flat. In the flat portion 40 of tray 19 is a substantially centrally located hole 41 extending therethrough. Hole 41 is sized to fit over hub 21 of support 16. Radially spaced from hole 41 is a plurality of openings 42 also in the flat portion of the tray, the openings disposed in a circular orientation and spaced substantially equally apart. Each opening 42 is generally rectangularly shaped and corresponds in size to aperture 29 in support 16. In addition, each opening 42 is spaced on a radius from a center point of the tray substantially the same distance that aperture 29 is spaced from its center on the support 16. Accordingly, openings 42 are arranged to individually align in registration with aperture 29 when tray 19 is attached to the surface of support 16. While the number of openings may vary according to the specific purpose of the tablet dispenser, there are preferably 21 or 28 openings to correspond with a similar number of tablets which are used for birth control purposes.

Surrounding hole 41 is an upraised annular portion 44 which lies between hole 41 and openings 42. Annular portion 44 has a substantially flat upper face 45 which is upraised to lie at about the same height as raised hub 21 of the support after the tray is attached thereto. It is noted that the upraised annular portion has a substantially U-shaped cross-section, thereby forming a hollow portion between the upstanding legs which extend vertically upward to support flat surface 45. Immediately surrounding hole 41 is an annular flange 46 which serves as a short circular lip to provide a means of connection between tray 19 and support 16. Located on flat upper face 45 is a plurality of indicators of periodicity 48. In this instance, indicators 48 are the abbreviations of the days of the week, and each indicator-day is referenced to an opening 42 in the tray. As can be seen in the drawings, the indicators are sequentially or chronologically arranged around the upper face. Being affixed to the upper face of the annular portion of the tray, indicators 48 thereby rotate with tray 19 when such rotation occurs. It is understood that a variety of indicators of periodicity may be chosen depending upon the type of tablets to be dispensed and their purpose and rate to be taken. Also, the indicators may be affixed to the upper face in many ways, including taping, raised molding and the like.

Tray 19 also includes an upstanding rim 43 around its periphery. Rim 43 serves to hold tablet package 20 in position in the tablet dispenser; to this end, rim 33 includes a number of small protuberances 47 which project inwardly. Tablet package 20 is slipped under these projections and is thus maintained relatively securely in the tablet dispenser. Since tablet package 20 is removable and replaceable, a notch 51 is provided in rim 53 to accommodate a tab on the tablet package so that the tablet package is assured of proper alignment on the tray even when the tray is rotated; additionally, notch 51 assists the user to conveniently remove the depleted tablet package and replace it with a new, full package. In addition, rim 43, in this instance, has serrations or the like around its upper edge to provide positive gripping by the user upon rotating the tray in the dispenser. Other positive gripping means, of course, may be employed to make the rotation step more convenient to the user.

Figure 6:
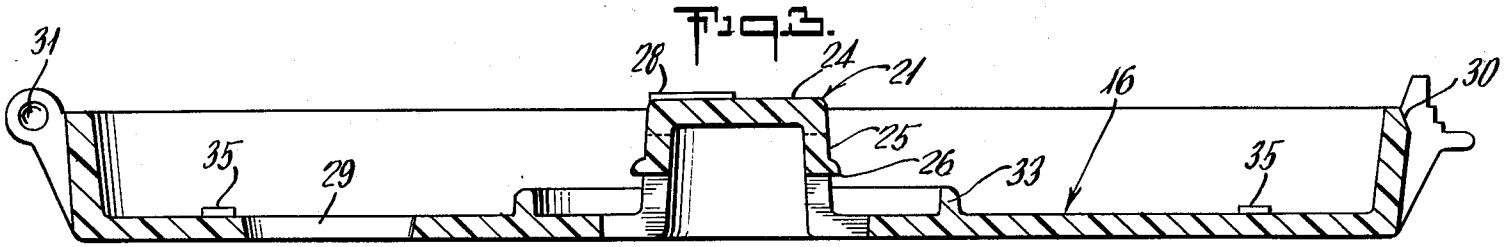
FIG. 6 is an enlarged perspective view of a fragmented section illustrating the mating ratchet teeth of the tray and support elements of the preferred tablet dispenser.

On the under surface of tray 19, the surface facing the flat portion of support 16, there is a second set of ratchet teeth 49. In this instance there are only three ratchet teeth 49 in this set, and they are spaced substantially equally apart and circularly located on a radius which is substantially the same as the radius of location of the first set of ratchet teeth 35 on support 16. Ratchet teeth 49 include an inclined edge 50 thereon and project from the tray to oppose the first set of ratchet teeth on the support. Thus, the two sets of ratchet teeth are adapted to become intermittently engaged with each other to thereby allow incremental rotation of the tray on the support in only one rotative direction, not the other. This rotation is accomplished by the orientation of the inclined surfaces and the vertical wall 52 on each tooth directly opposite the inclined surface. Referring briefly to FIG. 6, each ratchet tooth includes an inclined surface 50 and a vertical wall 52 opposite the inclined surface. When tray 19 is rotated on support 16 the opposed inclined surfaces slide on each other producing a slight lifting effect following which ratchet tooth 49 passes over ratchet tooth 35 and settles between adjacent ratchet teeth 35. Tray 19 cannot be rotated in the reverse direction since vertical wall 52 on the opposed set of teeth effectively block such a reverse rotation. Thus, the arrangement of the opposed sets of ratchet teeth not only allows incremental rotation of the tray on the support, but assists in aligning each opening 42 over aperture 29, and also locks the tray in position until the next incremental rotation is required.

Figure 7:
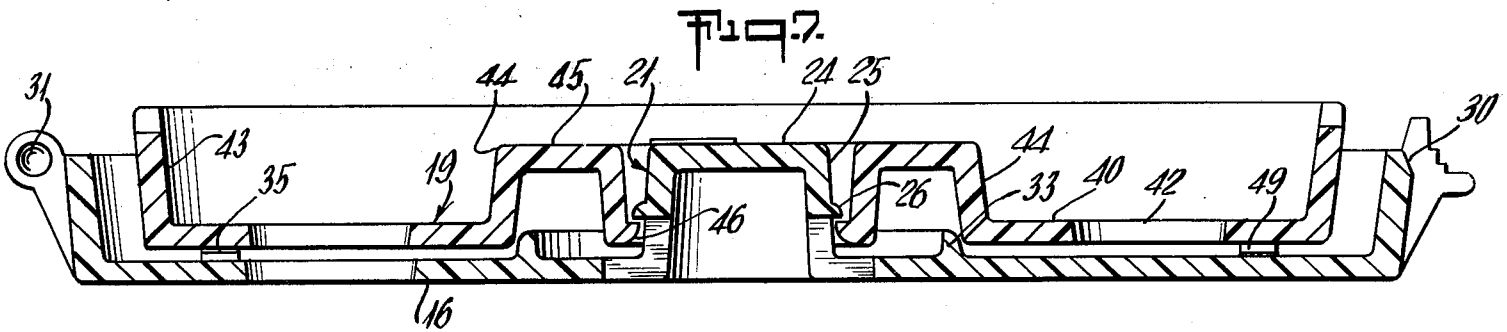
FIG. 7 is a cross-sectional view taken along lines 7—7 of FIG. 1.

The attachment of tray 19 to support 16 is more clearly illustrated in FIG. 7. In that drawing, flange 46 has been downwardly moved over resilient spokes 25 of hub 21. The resiliency of spokes 25 allows them to be squeezed inwardly to permit flange 46 to pass thereover, and then be retained in position by the spherical protuberance 26 on each resilient spoke 25 which spring back to their original position after the flange of the tray is seated on the support. As also seen in FIG. 7, annular ridge 33 locates against the leg forming the outside wall of the raised annular portion 44 of the tray. Accordingly, annular ridge 33 acts as a locator to prevent any excess lateral movement between the tray and the support after they have been connected. This attachment arrangement allows tray 19 to rotate on the surface of support 16 with minimal chance of detachment. In addition, this arrangement provides accurate concentricity between the rotating tray and the raised hub of the support, so that accurate alignment of the openings in the tray with the aperture in the support can be achieved.

Figure 8:
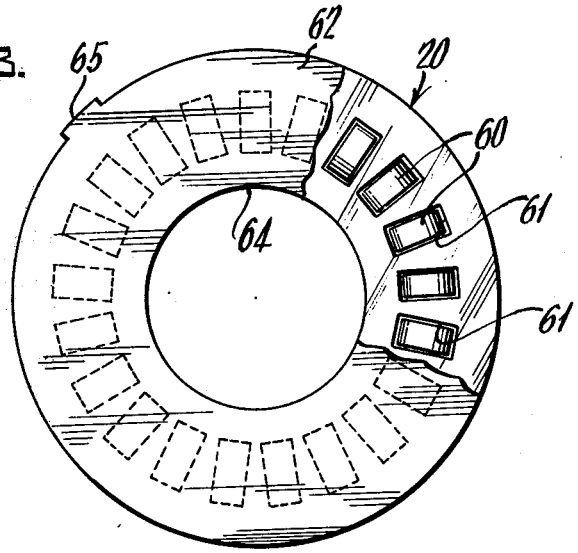
FIG. 8 is a bottom view of the removable tablet package specifically illustrating the frangible membrane covering each of the collapsible pockets and partially broken away to show the tablets within.
Figure 6:
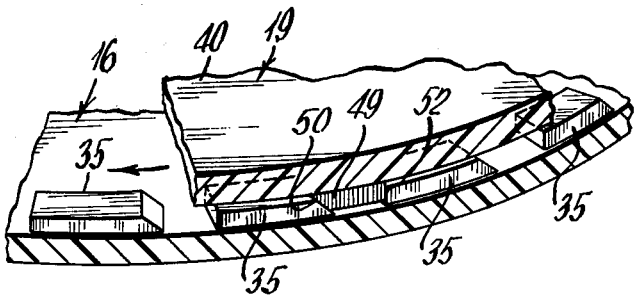

As best illustrated in FIGS. 1, 2 and 8, tablet package 20 contains a plurality of tablets 60 in a package which is commonly known as a "blister pack" or "blister sheet." Basically, the blister pack is comprised of a thin plastic or other easily formable material which has been formed into a plurality of collapsible pockets 61; pockets 61 are arranged in a circular orientation and substantially equally spaced apart to correspond with the orientation of openings 42 in tray 19 so that each pocket 61 and tablet 60 therein are aligned with an opening in the tray. Each pocket is shaped and sized so as to enable commonly sized and shaped tablets or other solid-form pharmaceutical preparations to fit completely therein. It can be seen that the tablets 60 are substantially circularly shaped pills and are positioned to stand on their circumferential edges in each of their respective pockets. This tablet positioning is preferred inasmuch as they take up less space than pills which lie flat, and the tablets are more conveniently pushed through the aperture from this position. In the manufacture of tablet package 20 of the blister pack type, after the tablets have been placed into the pockets, in this instance, twenty-one(21) tablets to correspond with the same number of openings in the tray, the pockets are covered with a frangible membrane 62. Frangible membrane 62 is a thin sheet of material, such as foil or the like, which may be sealed to the plastic material forming the pockets. Although each pocket 61 may be covered individually, for economies and ease of manufacture, frangible membrane 62 is a single sheet covering all of pockets 61. Accordingly, once pockets 61 are covered, tablets 60 therein are maintained in position and are prevented from dropping out of the package due to their own weight. Tablet package 20 thus is a unitary structure in itself, which provides easy handleability for placement into the tray of the dispenser, and then subsequent removal upon exhaustion of the tablet supply. It is noted in the drawings that tablet package 20 includes a central opening 64 in order to fit over raised annular portion 44 of the tray, and also includes a short projecting tab 65 which fits into notch 51 on the tray. The combined effect of tab 65 and notch 51 is to assure alignment of pockets 61 over openings 42 of the tray while preventing rotation of tablet package 20 while resting on the tray. In this regard, when tray 19 is rotated by the user, tablet package 20 also rotates therewith. In the assembled condition, tablet package 20 is disposed on tray 19 so that frangible membrane 62 is interposed between pockets 61 and openings 42 on the tray. Thus, in order for each tablet to pass through its corresponding opening, the frangible membrane must first be ruptured to allow such passage. Without sufficient applied force to the collapsible pocket, the tablet will remain therein during normal use of the dispenser.

Use of the tablet dispenser of the present invention is more clearly shown by referring to FIGS. 1 and 9. The user rotates tray 19 until the specific mark 48 indicating the first day on which a tablet is to be taken is in alignment with pointer 28 (this also aligns the tablet corresponding with that particular day in registry with the aperture 29 in support 16). When it is time to take the tablet, the user presses downwardly on collapsible pocket 61 thereby urging the tablet to fracture frangible membrane 62 and thus pass through its corresponding opening in the tray and then through aperture 29 in the support for collection. When it is time for the next tablet to be taken, in this instance, the next day, the user merely rotates tray 19 so that the next adjacent tablet is in alignment with pointer 28, once again placing that next tablet in registry with the aperture in the support. The ratchet teeth, unseen to the user, control the rotation so that each tablet passes incrementally over and in registration with the aperture. This procedure continues until the supply of tablets is exhausted, whereupon the user merely lifts out the empty tablet package and replaces the same with another package containing a full supply of tablets.

While the materials for the elements of the tablet dispenser are generally left to choice and compatibility with the functions of the dispenser, the support, tray and cover are preferably made of plastic. Plastic materials such as general purpose polystyrene are conveniently injection molded into the desired configurations, while providing sufficient rigidity and durability for continual, frequent use of the dispenser. As alluded to briefly above, the blister pack tablet package has the collapsible pockets made from plastic, and inasmuch as they contain the tablets, it is preferable that the plastic be clear to provide the user with a clear view of the tablets. From the dimensional standpoint, it is preferable that the dispenser be sufficiently compact to fit in the palm of the user's hand. Typically, the diameter of the circular tray which has twenty-one (21) openings therein is about 2.5 inches (6.3 cm.), while the support is slightly larger.

Thus, there has been provided a tablet dispenser for dispensing tablets or the like solid-form pharmaceutical preparations according to a time related regimen whereby the user thereof is plainly informed when the tablet should be taken thereby eliminating the uncertainty and confusion which often accompanies the taking of such preparations.

What is claimed is:

1. A tablet dispenser comprising: a substantially flat support having a single tablet dispensing aperture therein; a tray rotatably attached to one surface of said support, said tray having a plurality of openings therein, said openings disposed in a circular orientation and spaced substantially equally apart, said openings arranged to individually align in registration with said aperture in said support upon rotation of said tray relative to said support, each of said openings having an indicator of periodicity associated therewith, said indicators being sequentially arranged from one opening to the next and being rotatable with said tray; and a removable tablet package disposed on said tray comprising a plurality of collapsible pockets each containing a tablet therein, said pockets arranged in a circular orientation and substantially equally spaced apart to thereby correspond with the orientation of said openings in said tray so that a tablet is disposed in alignment with each of said openings, said pockets being covered with a frangible membrane interposed between said pockets and said openings, said package being rotatable with said tray, whereby a tablet is dispensed by collapsing the pocket which is in registry with said aperture, thereby urging said tablet to fracture said membrane and pass through its corresponding opening and then through said aperture in said support for collection by the operator thereof, said package being removable and replaceable in said tray when the supply of tablets has been exhausted.

2. A tablet dispenser as defined in claim 1 which further includes means for providing incremental rotation of said tray on said support to align each opening with said aperture as each individual opening passes thereover, and to maintain said alignment until said tray is incrementally rotated to the next opening by the operator thereof.

3. A tablet dispenser as defined in claim 2 wherein said incremental rotation providing means includes a first set of ratchet teeth upstanding from said support, and a second set of ratchet teeth projecting from said tray and opposed to said first set, said sets of teeth adapted to become intermittently engaged with each other to allow incremental rotation of said tray on said support in one rotative direction, but not the other, said sets of teeth disposed so that each opening of said tray locks in alignment with said aperture as the individual openings pass thereover.

4. A tablet dispenser as defined in claim 1 wherein said support includes a raised hub substantially centrally located on said support, and wherein said tray has a substantially central hole therethrough to fit over said hub whereby said tray is rotatable around said hub of said support.

5. A tablet dispenser as defined in claim 4 wherein said tray has an upraised annular portion surrounding said central hole and lying between said hole and said plurality of openings, said annular portion having a substantially flat upper face, said upper face being the location where said indicators of periodicity are referenced to said individual openings in said tray.

6. A tablet dispenser as defined in claim 1 wherein said tablets are substantially circularly shaped pills and are positioned to stand on their circumferential edges in each of said pockets.

7. A tablet dispenser as defined in claim 1 which further includes a cover for protection of said tablet package until the operator desires to dispense a tablet.

8. A tablet dispenser as defined in claim 7 wherein said cover is hingedly attached to said support to provide access to said tablet package on said support.

9. A tablet dispenser comprising: a substantially flat support having a single tablet dispensing aperture therein; a tray adapted to rotate on one surface of said support, said tray having a plurality of openings therein, said openings being disposed in a circular orientation and arranged to individually align in registration with said aperture in said support upon rotation of said tray; and a collapsible pocket containing a tablet therein associated with each opening of said tray, each tablet being prevented from passing through its corresponding opening under its own weight by a frangible membrane covering said openings, whereby a tablet is dispensed by collapsing the pocket which is in registry with said aperture, thereby urging said tablet to fracture said membrane and pass through its corresponding opening and then through said aperture in said support for collection by the operator thereof.

10. A tablet dispenser as defined in claim 9 which further includes an indicator of periodicity associated with each of said openings, said indicators being sequentially arranged from one opening to the next.

11. A tablet dispenser as defined in claim 9 wherein said collapsible pockets, said tablets, and said frangible membrane comprise a separate tablet package disposed on said tray with said pockets arranged to correspond with said circular orientation of said openings in said tray so that each pocket and opening are substantially in alignment, said frangible membrane being interposed between said pockets and said openings.

12. A tablet dispenser comprising: a substantially flat support having a single tablet dispensing aperture therein, said support including a raised hub substantially centrally located thereon, said aperture being spaced apart from said hub; a tray rotatably attached to the surface of said support which includes said hub, said tray having a substantially central hole therethrough to fit over said hub, said tray having a plurality of openings therein disposed in a circular orientation and spaced substantially equally apart, said openings arranged to individually align in registration with said aperture in said support upon incremental rotation of said tray relative to said support, said tray having an upraised annular portion surrounding said central hole and lying between said hole and said plurality of openings, said annular portion including a substantially flat upper face with indicators of periodicity being located thereon, an indicator referenced to each opening in said tray and sequentially arranged around said upper face; a first set of ratchet teeth upstanding from said support and a second set of ratchet teeth projecting from said tray and opposed to said first set, said sets of teeth adapted to become intermittently engaged with each other to allow incremental rotation of said tray on said support in one rotative direction, but not the other, said sets of teeth disposed so that each opening of said tray locks in alignment with said aperture as the individual openings pass thereover; and a removable tablet package disposed on said tray comprising a plurality of collapsible pockets each containing a tablet therein, said pockets disposed in a circular orientation and substantially equally spaced apart to thereby correspond with the orientation of said openings in said tray so that a tablet is disposed in alignment with each of said openings, said pockets being covered with a frangible membrane interposed between said pockets and said openings, said package being rotatable with said tray; a cover hingedly attached to said support and adapted to protectively cover said tablet package until the operator desires to dispense a tablet whereupon said cover swings open to provide access to said package; whereby a tablet is dispensed by collapsing the pocket which is in registry with said aperture, thereby urging said tablet to fracture said membrane and pass through its corresponding opening and then through said aperture in said support for collection by the operator thereof, said package being removable and replaceable in said tray when the supply of tablets has been exhausted.

13. A tablet dispenser as defined in claim 12 wherein said tablets are substantially circularly shaped pills and are positioned to stand on their circumferential edges in each of their respective pockets.

14. A tablet dispenser as defined in claim 12 wherein said frangible membrane is a single sheet of frangible material covering the entire plurality of pockets.

15. A tablet dispenser as defined in claim 12 which further includes a pointer on said hub pointing in the direction of said aperture in said support.

16. A device for dispensing tablets comprising: a substantially flat support having a single tablet dispensing aperture therein; a tray adapted to rotate on one surface of said support, said tray having a plurality of openings therein, said openings being disposed in a circular orientation and arranged to individually align in registration with said aperture in said support upon rotation of said tray, said tray adapted to receive a tablet dispensing package containing a plurality of tablets, said tablets being individually dispensable through the opening in said tray which is aligned with said aperture.

17. A device as defined in claim 16 which further includes an indicator of periodicity associated with each of said openings, said indicators being sequentially arranged from one opening to the next.

18. A device as defined in claim 16 which further includes a cover adapted to overlie said tray when closed and to provide access to said tray when opened.

19. A device for dispensing tablets comprising: a substantially flat support having a single tablet dispensing aperture therein; a tray rotatably attached to one surface of said support, said tray having a plurality of openings therein, said openings disposed in a circular orientation and spaced substantially equally apart, said openings arranged to individually align in registration with said aperture in said support upon incremental rotation of said tray relative to said support, each of said openings having an indicator of periodicity associated therewith, said indicators being sequentially arranged from one opening to the next and being rotatable with said tray; and a cover adapted to overlie said tray when closed and to provide access to said tray when opened, said tray adapted to receive a tablet dispensing package containing a plurality of tablets, said tablets being individually dispensable through the specific opening in said tray which is aligned with said aperture.

20. A device as defined in claim 19 which further includes means for providing incremental rotation of said tray on said support to align each opening with said aperture as each individual opening passes thereover, and to maintain said alignment until said tray is incrementally rotated to the next opening by the operator thereof.

21. A device as defined in claim 20 wherein said incremental rotation providing means includes a first set of ratchet teeth upstanding from said support, and a second set of ratchet teeth projecting from said tray and opposed to said first set, said sets of teeth adapted to become intermittently engaged with each other to allow incremental rotation of said tray on said support in one rotative direction, but not the other, said sets of teeth disposed so that each opening of said tray locks in alignment with said aperture as the individual openings pass thereover.

22. A device as defined in claim 19 wherein said support includes a raised hub substantially centrally located on said support, and wherein said tray has a substantially central hole therethrough to fit over said hub whereby said tray is rotatable around said hub of said support.

23. A device as defined in claim 22 wherein said tray has an upraised annular portion surrounding said central hole and lying between said hole and said plurality of openings, said annular portion having a substantially flat upper face, said upper face being the location where said indicators of periodicity are referenced to said individual openings in said tray.

24. A device as defined in claim 19 wherein said cover is hingedly attached to said support.

* * * * *